US005388640A

United States Patent [19]

Puri et al.

[11] Patent Number: 5,388,640

[45] Date of Patent: Feb. 14, 1995

[54] METHOD FOR PRODUCING METHANE-CONTAINING GASEOUS MIXTURES

[75] Inventors: Rajen Puri, Aurora, Colo.; Dan Yee, Tulsa, Okla.

[73] Assignee: Amoco Corporation, Chicago, Ill.

[21] Appl. No.: 147,121

[22] Filed: Nov. 3, 1993

[51] Int. Cl.[6] ..... E21B 43/18

[52] U.S. Cl. ..... 166/263; 166/268

[58] Field of Search ..... 166/263, 266, 268, 305.1; 299/4, 5

[56] References Cited

U.S. PATENT DOCUMENTS

| | | | |
|---|---|---|---|
| 4,043,395 | 8/1977 | Every et al. | 166/263 |
| 4,400,034 | 8/1983 | Chew | 299/5 |
| 4,446,921 | 5/1984 | Coenen et al. | 166/267 |
| 4,544,037 | 10/1985 | Terry | 166/369 |
| 4,756,367 | 7/1988 | Puri et al. | 166/263 |
| 4,883,122 | 11/1989 | Puri et al. | 166/263 |
| 5,014,785 | 5/1991 | Puri et al. | 166/263 |
| 5,014,788 | 5/1991 | Puri et al. | 166/308 |
| 5,085,274 | 2/1992 | Puri et al. | 166/252 |
| 5,099,921 | 3/1992 | Puri et al. | 166/266 |
| 5,133,406 | 7/1992 | Puri | 166/266 |
| 5,147,111 | 9/1992 | Montgomery | 299/16 |

FOREIGN PATENT DOCUMENTS 609917 6/1978 U.S.S.R. .

OTHER PUBLICATIONS

M. G. Zabetakis, et al., "Methane Control in United States Coal Mines–1972", U.S. Bureau of Mines, Information Circular 8600, pp. 8–16, (1973).

R. S. Metcalfe, D. Yee, J. P. Seidle, and R. Puri, "Review of Research Efforts in Coalbed Methane Recovery", SPE 23025, (1991).

M. D. Stevenson, W. V. Pinczewski and R. A. Downey, "Economic Evaluation of Nitrogen Injection for Coalseam Gas Recovery", SPE 26199, (1993).

"Development and Operation of Gas Fields", *Handbook of Natural Gas Engineering*. Donald L. Katz et al., New York: McGraw Hill Book Company, pp. 435–464 (1959).

N. Ali, P. K. Singh, C. P. Peng, G. S. Shiralkar, Z. Moschovidis and W. L. Baack, "Injection Above-Parting-Pressure Waterflood Pilot, Valhall Field, Norway", SPE 22893, (1991).

R. Puri and D. Yee, "Enhanced Coalbed Methane Recovery", SPE 20732, (1990).

Brian Evison and R. E. Gilchrist, "New Developments in Nitrogen in the Oil Industry", SPE 24313, (1992).

Alan A. Reznik, Pramod K. Singh and William L. Foley, "An Analysis of the Effect of Carbon Dioxide Injection on the Recovery of In-Situ Methane from Bituminous Coal: An Experimental Simulation", SPE/DOE 10822, (1982).

Ralph W. Veatch, Jr., Zissis A. Mosachovidis and C. Robert Fast, "An Overview of Hydraulic Fracturing", (List continued on next page.)

*Primary Examiner*—George A. Suchfield

*Attorney, Agent, or Firm*—Scott P. McDonald; Richard A. Kretchmer

[57] ABSTRACT

A method is disclosed for increasing the production of methane from a solid carbonaceous subterranean formation having a standard initial production rate of a methane-containing gas of X standard cubic feet per unit time. The method comprises the steps of injecting an inert methane-desorbing gas into the formation; terminating injection of the methane-desorbing gas; and thereafter recovering greater than X standard cubic feet per unit time of a methane-containing gas from the formation. In some embodiments, a number of well systems exceeding the number of available inert gas production and injection units can be operated in accordance with the present invention to yield greater methane-containing gas production than would be obtained if the available injection systems were dedicated continuously to particular well systems.

40 Claims, 2 Drawing Sheets

OTHER PUBLICATIONS

*Recent Advances in Hydraulic Fracturing*, vol. 12, chapter 1, pp. 1–38, S.P.E. Monograph Series, (1989).

N. R. Warpinski and Michael Berry Smith, "Rock Mechanics and Fracture Geometry", *Recent Advances in Hydraulic Fracturing*, vol. 12, chapter 3, pp. 57–80, S.P.E. Monograph Series, (1989).

"Quarterly Review of Methane from CoalSeams Technology", *Gas Research Institute*, vol. 11, No. 1, p. 38, (1993).

Carl L. Schuster, "Detection Within the Wellbore of Seismic Signals Created by Hydraulic Fracturing", SPE 7448, (1978).

Amoco Production Company, Handout distributed at the International Coalbed Methane Symposium held in Birmingham, Alabama, May 17–21, 1993.

Application for Enhanced Recovery Nitrogen Injection Pilot and Approval of Aquifer Exemption, submitted to the Colorado Oil and Gas Conservation Commission, Aug. 30, 1990.

Durango Herald Newspaper Article, "Planners OK Amoco Facilities", dated May 15, 1991.

La Plata County Planning Commission, Colorado Planning Commission Information Session of Mar. 1991 dealing with Amoco's Planned Nitrogen Injection Pilot.

United States Environmental Protection Agency Region VIII, Transmittal Letter of Feb. 11, 1992 approving Nitrogen Injection Pilot and Associated Permits.

Nov. 9, 1990, Report of the Oil and Gas Conservation Commission of the State of Colorado.

METHOD FOR PRODUCING METHANE-CONTAINING GASEOUS MIXTURES

FIELD OF THE INVENTION

This invention generally relates to a method for increasing the production of methane-containing gaseous mixtures from solid carbonaceous subterranean formations. The invention more particularly relates to methods for improving the natural gas production rate from a solid carbonaceous subterranean formation by injecting a gas capable of desorbing methane, terminating injection of the gas, and recovering a gas containing methane at a rate exceeding a pre-injection production rate.

BACKGROUND OF THE INVENTION

Methane is believed to be produced by various thermal and biogenic processes responsible for converting organic matter to solid carbonaceous subterranean materials such as coals and shales. When methane is produced in this manner, the mutual attraction between the carbonaceous solid and the methane molecules frequently causes a large amount of methane to remain trapped in the solids along with water and lesser amounts of other gases which can include nitrogen, carbon dioxide, various light hydrocarbons, argon and oxygen. When the trapping solid is coal, the methane-containing gaseous mixture that can be obtained from the coal contains at least about 95 volume percent methane and is known as "coalbed methane." The worldwide reserves of coalbed methane are huge.

Coalbed methane has become a significant source of the methane distributed in natural gas. Typically, coalbed methane is recovered by drilling a wellbore into a subterranean coalbed having one or more methane-containing coal seams that form a coalbed. The pressure difference between the ambient coalbed pressure (the "reservoir pressure") and the wellbore provides a driving force for flowing coalbed methane into the wellbore. As the ambient coalbed pressure decreases, methane is desorbed from the coal. Unfortunately, this pressure reduction also reduces the driving force necessary to flow methane into the wellbore. Consequently, pressure depletion of coalbeds becomes less effective with time, and is generally believed capable of recovering only about 35 to 50% of the methane contained therein.

An improved method for producing coalbed methane is disclosed in U.S. Pat. No. 5,014,785 to Purl, et al. In this process, a methane-desorbing gas such as an inert gas is injected through an injection well into a solid carbonaceous subterranean formation such as a coalbed. At the same time, a methane-containing gas is recovered from a production well. The desorbing gas, preferably nitrogen, mitigates bed pressure depletion and is believed to desorb methane from the coalbed by decreasing the methane partial pressure within the bed. Recent tests confirm that this process yields increased coalbed methane production rates and suggest that the total amount of recoverable methane may be as high as 80% or more.

While Puri discloses improved methods for recovering a methane-containing process stream from solid carbonaceous subterranean formations, the long-term commitment of the process equipment required to inject a methane-desorbing gas into a formation is expensive and may in some cases render the process economically unfavorable.

Additionally, as will be demonstrated by an Example contained herein, long-term injection of an inert gas into a formation may result in the production of a methane-containing gas having an inert gas fraction that generally increases in volume percent with time. This result may be undesirable as it may be necessary to lessen the concentration of injected inert gas in the produced methane-containing mixture before the mixture can be transferred into a natural gas pipeline or otherwise utilized.

What is needed is an improved process for the recovery of methane from solid carbonaceous subterranean formations that increases methane production rates without requiring the constant or nearly constant dedication of inert gas production and injection equipment to each individual injection well. Preferably, the process should provide a methane-containing gas that contains as little of the injected inert gas as possible to mitigate the costs associated with removing the injected gas from the produced methane-containing gaseous mixture.

SUMMARY OF THE INVENTION

Each aspect of the invention described below takes advantage of our discovery that injection of a methane-desorbing gas into a solid subterranean carbonaceous formation can yield increased gas production rates after injection of the methane-desorbing gas has been terminated. This period of post-injection elevated production, hereafter referred to as the "tail" period, provides for the recovery of a large quantity of gas at production rates greater than the standard initial production rate of the well, thereby eliminating the need for and costs associated with operating inert gas production and injection equipment during the tail period.

A first aspect of the invention is directed to a method for increasing the production of methane from a solid carbonaceous subterranean formation having a standard initial production rate of a methane-containing gas of X standard cubic feet per unit time, said method comprising the steps of injecting an inert methane-desorbing gas into the formation; recovering greater than X standard cubic feet per unit time of a first methane-desorbing gas from the formation during the injecting step; terminating injection of the methane-desorbing gas; and thereafter recovering greater than X standard cubic feet per unit time of a methane-containing gas from the formation.

The term "solid carbonaceous subterranean formation" as used herein refers to any underground geological formation which contains methane in combination with significant amounts of solid organic material. Solid carbonaceous subterranean formations include but are not limited to coals and shales.

The term "standard initial production rate" as used herein refers to the actual or predicted methane-containing gas production rate of a production well immediately prior to flowing a methane-desorbing gas through the well to increase its production rate. A standard initial production rate may be established, for example, by allowing a well to operate as a pressure depletion well for a relatively short period of time just prior to inert gas injection. The standard initial production rate can then be calculated by averaging the production rate over the period of pressure depletion operation. If this method is used, the well preferably will have been operated long enough that the transient variations in production rates do not exceed about 25% the average production rate. Preferably, the "standard initial production rate" is determined by maintaining constant operating conditions, such as operating at a constant bottom hole flowing pressure with little or no fluid level. Alternatively, a "standard initial production rate" may be calculated based on reservoir parameters, as discussed in detail herein, or as otherwise would be calculated by one of ordinary skill in the art.

The term "inert methane-desorbing gas" as used herein refers to any gas or gaseous mixture that contains greater than fifty volume percent of a relatively inert gas or gases. A relatively inert gas is a gas that promotes the desorption of methane from a solid carbonaceous subterranean formation without being strongly adsorbed to the solid organic material present in the formation or otherwise chemically reacting with the solid organic material to any significant extent. Examples of relatively inert gases include nitrogen, argon, air, helium and the like, as well as mixtures of these gases. An example of a strongly desorbed gas not considered to be a relatively inert gas is carbon dioxide.

The term "recovering" as used herein means a controlled collection and/or disposition of a gas, such as storing the gas in a tank or distributing the gas through a pipeline. "Recovering" specifically excludes venting the gas into the atmosphere.

A second aspect of the invention is directed to a method for increasing the production of methane from a coalbed having a standard initial production rate of a methane-containing gas of X standard cubic feet per unit time, said method comprising the steps of injecting an inert methane-desorbing gas into the coalbed at a formation location; terminating injection of the methane-desorbing gas; and thereafter recovering a methane-containing gas from the coalbed at a rate greater than 1.5× standard cubic feet per unit time in the absence of inert methane-desorbing gas injection into the formation location.

The term "coalbed" as used herein refers to a single coal seam or a plurality of coal seams which contain methane and through which an injected gas can be propagated.

As used herein, the term "formation location" means a location within a solid carbonaceous subterranean formation such as a coalbed into which an inert methane-desorbing gas can be injected to increase methane-containing gas production from a production well in fluid communication with the point of gas injection. Inert gas typically is injected from the surface into such a location through one or more injection wells bored into the formation.

A third aspect of the invention is directed to a method for increasing the production of methane from a first and second well penetrating at least one solid carbonaceous subterranean formation, said first and second wells having standard initial production rates of methane-containing gas of X and Y standard cubic feet per unit time, respectively. The method includes the steps of injecting a first inert methane-desorbing gas into a first formation location to enhance the rate of methane-containing gas recovery from the first well; terminating injection of the methane-desorbing gas into the first formation location; and, thereafter, injecting a methane-desorbing gas into a second formation location to enhance the rate of methane-containing gas recovery from the second well while recovering greater than X standard cubic feet per unit time of a methane-containing gas from the first well.

In several preferred embodiments of the invention, the methane-containing gas recovered during the post-injection period contains a generally decreasing volume percent of the injected inert methane-desorbing gas, thereby rendering the produced methane-containing gas more suitable for mixing into a natural gas pipeline.

Each of the foregoing aspects of the invention provides an improved methane-producing technology because each aspect provides for a production rate from a well which is greater than the standard initial methane-containing gas production rate, without requiring the continuous or nearly continuous injection of inert methane-desorbing gas. Furthermore, because the invention provides for a period of improved production after methane-desorbing gas injection has been terminated, the gas injection equipment initially used to increase production from a first well can be relocated and utilized to enhance production from one or more additional wells while production from the well into which methane-desorbing gas was initially injected into remains enhanced above the standard initial production rate.

DETAILED DESCRIPTION OF THE INVENTION

Figure 1:
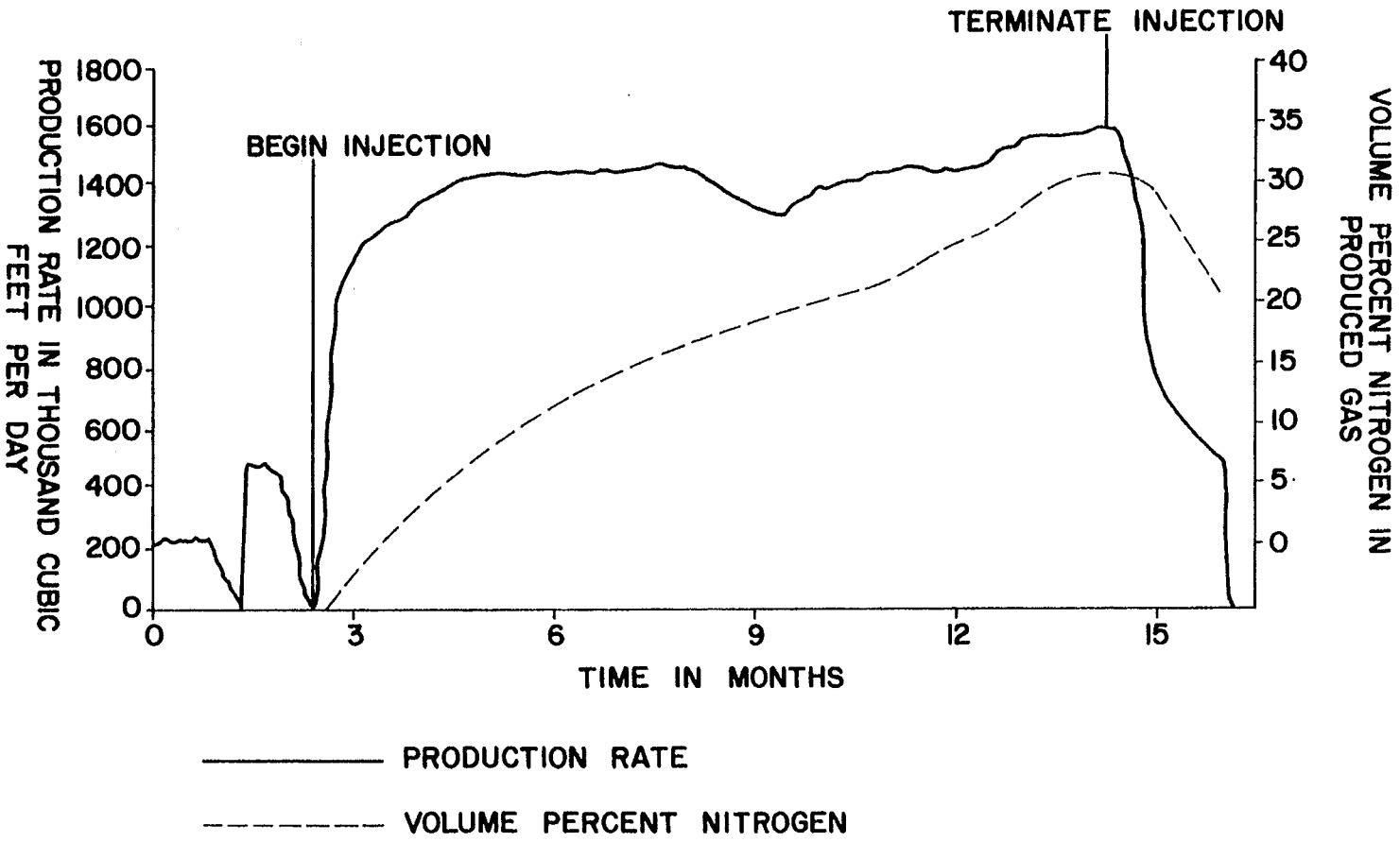
FIG. 1 is a plot of total gas production and percent nitrogen present in a produced gas for a pilot plant operated in accordance with the present invention.

The following detailed description describes several processes in accordance with the present invention. Each process exploits our surprising discovery that methane-desorbing gas injection can yield improved methane-containing gas production during a "tail" period after injection of the gas has stopped. The embodiments of the invention provided below are meant to be illustrative only. While many of these embodiments are processes in which nitrogen is injected into a coalbed, the description of these embodiments is not meant to limit the type of injected gas used or the type of methane-containing formation into which gas can be injected beyond that which is recited in the appended claims.

Each embodiment of the invention requires the injection of an inert methane-desorbing gas into a solid carbonaceous subterranean formation such as a coalbed. The methane-desorbing gas typically is injected into the formation through one or more injection wells terminating in or in fluid communication with the formation.

Inert methane-desorbing gases suitable for use in the invention include any gas that promotes the desorption of methane from a solid carbonaceous subterranean formation without being significantly adsorbed to the solid organic material present in the formation or otherwise reacting with the solid organic material. Examples of such gases include nitrogen, argon, air, helium and the like, as well as mixtures of these gases. As used herein, the term "air" refers to any gaseous mixture containing at least 15 volume percent oxygen and at least 60 volume percent nitrogen. Preferably, "air" is the atmospheric mixture of gases found at the well site and contains between about 20 and 22 volume percent oxygen and 78 and 80 volume percent nitrogen.

Although atmospheric air is a cheap and plentiful inert methane-desorbing gas suitable for use in the invention, nitrogen-rich gases having a greater volume percent of nitrogen than is present in air are the preferred inert methane-desorbing gases. A preferred feedstock for producing nitrogen rich-gases is atmospheric air, although other gaseous mixtures of oxygen and less reactive gases may be used if available. Such other mixtures may be produced by using or mixing gases obtained from processes such as the cryogenic upgrading of nitrogen-containing low BTU natural gas.

Preferably, the injected gas contains at least 90 volume percent nitrogen, but most preferably, greater than 95 volume percent nitrogen. Many techniques for producing nitrogen-enriched gaseous mixtures from nitrogen-containing gaseous mixtures are known in the art. Three suitable techniques are membrane separation, pressure swing adsorption and cryogenic separation. It should be noted that each of these methods can also be used to produce other suitable inert methane-desorbing gases and mixtures thereof from feedstocks other than atmospheric air if such feedstocks are sufficiently available.

If membrane separation techniques are employed to produce a nitrogen-rich mixture from air, air should be introduced into the membrane separator unit under pressure, preferably at a rate sufficient to produce an oxygen-depleted gaseous effluent stream having a nitrogen to oxygen volume ratio of at least 9:1. Any membrane separator unit capable of separating oxygen from nitrogen can be used for this purpose. One such membrane separator is the "NIJECT" unit available from Niject Services Co. of Tulsa, Okla. Another suitable unit is the "GENERON" unit available from Generon Systems of Houston, Tex.

Membrane separators such as the "NIJECT" and "GENERON" units typically include a compressor section for compressing air and a membrane section for fractionating the air. The membrane sections of both the "NIJECT" and "GENERON" separation units employ hollow fiber membrane bundles. The membrane bundles are selected to be relatively more permeable to a gas or gases required in a first gas fraction such as oxygen, and relatively impermeable to a gas or gases required to be in a second gas fraction, such as nitrogen, carbon dioxide and water vapor. Inlet air is compressed to a suitable pressure and passed through the fibers or over the outside of the fibers.

In a "NIJECT" separator, compressed air on the outside of the hollow fibers provides the driving energy for having oxygen, carbon dioxide and water permeate into the hollow fibers while oxygen-depleted nitrogen remains outside of the fibers. The nitrogen-rich effluent leaves the unit at about the inlet pressure of 50 psi or higher, typically at a pressure of at least 100 psi.

In a "GENERON" separator, compressed air passes through the inside of the hollow fibers. This provides the energy to drive the oxygen-enriched air through the fiber walls. The nitrogen-rich gas inside the fibers leaves the separator at an elevated pressure of 50 psi or higher, also typically at a pressure of at least 100 psi.

Because the nitrogen-rich gas must be injected into formations which typically have an ambient reservoir pressure between about 500 and 2000 psi, it is preferred to use membrane separators which discharge the oxygen-deficient air at as high a discharge pressure as possible, as this reduces subsequent gas compression costs.

Membrane separators like those just discussed typically operate at inlet pressures of about 50 to 250 psi, and preferably about 100 to 200 psi, at a rate sufficient to reduce the oxygen content of the nitrogen-rich effluent to a volume ratio of nitrogen to oxygen of about 9:1 to 99:1. Under typical separator operating conditions, higher pressures applied to the membrane system increase gas velocity and cause the gas to pass through the system more quickly, thereby reducing the separating effectiveness of the membrane. Conversely, lower air pressures and velocities provide for a more oxygen-depleted effluent, but at a lower rate. It is preferable to operate the membrane separator at a rate sufficient to provide an oxygen-depleted effluent containing about 2 to 8 volume percent oxygen. When atmospheric air containing about 20 volume percent oxygen is processed at a rate sufficient to produce an oxygen-deficient fraction containing about 5 volume percent oxygen, the oxygen-enriched air fraction typically contains about 40 volume percent oxygen. Under these conditions, the nitrogen-rich effluent leaves the membrane separator at a superatmospheric pressure typically less than about 200 psi. Additional information concerning the use of membrane separators in enhanced methane production processes can be found in co-filed U.S. Ser. No. 08/147,111 which is hereby incorporated by reference.

Nitrogen-rich methane-desorbing gases may also be produced from air by a pressure swing adsorption process. This process typically requires first injecting air under pressure into a bed of adsorbent material that preferentially adsorbs oxygen over nitrogen. The air injection is continued until a desired saturation of the bed of material is achieved. The desired adsorptive saturation of the bed can be determined by routine experimentation.

Once the desired adsorptive saturation of the bed is obtained, the material's adsorptive capacity is regenerated by lowering the total pressure on the bed, thereby causing the desorption of an oxygen-enriched process stream. If desired, the bed can be purged before restarting the adsorption portion of the cycle. Purging the bed in this manner insures that oxygen-enriched residual gas tails will not reduce the bed capacity during the next adsorptive cycle. Preferably, more than one bed of material is utilized so that one adsorptive bed of material is adsorbing while another adsorptive bed of material is being depressurized or purged.

The pressure utilized during the adsorption and desorption portions of the cycle and the differential pressure utilized by the adsorptive separator are selected so as to optimize the separation of nitrogen from oxygen. The differential pressure utilized by the adsorption separator is the difference between the pressure utilized during the adsorption portion of the cycle and the pressure utilized during the desorption portion of the cycle. The cost of pressurizing the injected air is important to consider when determining what pressures to use.

The flow rate of the nitrogen-rich stream removed during the adsorption portion of the cycle must be high enough to provide an adequate flow but low enough to allow for adequate separation of the components of the air. Typically, the rate of air injection is adjusted so that, in conjunction with the previous parameters, the recovered nitrogen-rich effluent stream has a nitrogen-to-oxygen volume ratio of about 9:1 to 99:1.

Generally, the higher the inlet pressure utilized, the more gas that can be adsorbed by the bed. Also, the faster the removal of oxygen-depleted gaseous effluent from the system, the higher the oxygen content of the gaseous effluent. In general, it is preferred to operate the pressure swing adsorption separator at a rate sufficient to provide nitrogen-rich gas containing about 2 to 8 volume percent oxygen. In this way, it is possible to maximize production of nitrogen-rich gas and at the same time obtain the advantages implicit in injecting the nitrogen-rich gas into the formation.

A wide variety of adsorbent materials are suitable for use in a pressure swing adsorption separator. Adsorbent materials which are particularly useful include carbonaceous materials, alumina-based materials, silica-based materials, and zeolitic materials. Each of these material classes includes numerous material variants characterized by material composition, method of activation, and the selectivity of adsorption. Specific examples of materials which can be utilized are zeolites having sodium aluminosilicate compositions such as "4A"-type zeolite and "RS"-10 (a zeolite molecular sieve manufactured by Union Carbide Corporation), carbon molecular sieves, and various forms of activated carbon. Additional information concerning the use of pressure swing adsorbers in enhanced methane production processes can be found in co-filed U.S. Ser. No. 08/147,125, which is hereby incorporated by reference.

A third method for preparing a nitrogen-rich gas from air is cryogenic separation. In this process, air is first liquified and then distilled into an oxygen fraction and a nitrogen fraction. While cryogenic separation routinely can produce nitrogen fractions having less than 0.01 volume percent oxygen contained therein and oxygen fractions containing 70 volume percent or more oxygen, the process is extremely energy-intensive and therefore expensive. Because the presence of a few volume percent oxygen in a nitrogen-rich gas is not believed to be detrimental when such a stream is used to enhance methane recovery from a methane-containing formation, the relatively pure nitrogen fraction typically produced by cryogenic separation will not ordinarily be cost-justifiable.

Other methods for producing suitable inert gas mixtures will be known to those skilled in the art. Matters to be considered when choosing an inert methane-desorbing gas include the availability of the gas at or near the injection site, the cost to produce the gas, the quantity of gas to be injected, the volume of methane displaced from the solid methane-containing material by a given volume of the inert gas, and the cost and ease of separating the gas from the mixture of methane and inert gas collected from the formation.

The inert methane-desorbing gas must be injected into the solid carbonaceous subterranean formation at a pressure higher than the reservoir pressure and preferably lower than the parting pressure of the formation. If the injection pressure is too low, the gas cannot be injected. If the injection pressure is too high and the formation fractures, the gas may be lost through the fractures. In view of these considerations and the pressure encountered in typical formations, the methane-desorbing gas typically will be pressurized to about 400 to 2000 psi in a compressor before injecting the stream into the formation through one or more injection wells terminating in or in fluid communication with the formation.

In some cases, it may be desirable to inject methane-desorbing gases into a formation at a pressure above the formation parting pressure if fractures are not induced which extend from an injection well to a production well. Injection pressures above the formation parting pressure may cause additional fracturing that increases formation injectability, which in turn can increase methane recovery rates. Preferably, the fracture half-lengths of formation fractures induced by injecting above the formation parting pressure are less than about 20% to about 30% of the spacing between an injection well and a production well. Also, preferably, the induced fractures should not extend out of the formation.

Parameters important to methane recovery such as fracture half-length, azimuth, and height growth can be determined using formation modeling techniques known in the art. Examples of such techniques are discussed in John L. Gidley, et al., Recent Advances in Hydraulic Fracturing, Volume 12, Society of Petroleum Engineers Monograph Series, 1989, pp. 25–29 and pp. 76–77; and Schuster, C. L., "Detection Within the Wellbore of Seismic Signals Created by Hydraulic Fracturing," paper SPE 7448 presented at the 1978 Society of Petroleum Engineers' Annual Technical Conference and Exhibition, Houston, Tex., October 1–3. Alternatively, fracture half-lengths and orientation effects can be assessed using a combination of pressure transient analysis and reservoir flow modeling such as described in paper SPE 22893, "Injection Above Fracture Parting Pressure Pilot, Valhal Field, Norway," by N. Ali et al., 69th Annual Technical Conference and Exhibition of the Society of Petroleum Engineers, Dallas, Tex., October 6–9, 1991. While it should be noted that the above reference describes a method for enhancing oil recovery by injecting water above the formation parting pressure, it is believed that the methods and techniques discussed in SPE 22893 can be adapted to enhance methane recovery from a solid carbonaceous subterranean formation such as a coalbed.

Inert gas injection rates useful in the invention can be determined empirically. Typical injection rates can range from about 300,000 to 1,500,000 standard cubic feet per day, with the higher rates being preferred. The injection of the methane-desorbing gas into the formation may be continuous or discontinuous, although generally continuous injection is preferred. The injection pressure may be maintained constant or varied, with relatively constant pressure being preferred.

Injection of the inert gas into the formation generally enhances the production of methane front the formation. The timing and magnitude of the increase in the rate of methane recovery from a production well will depend on many factors including, for example, well spacing, seam thickness, cleat porosity, injection pressure and injection rate, injected gas composition, sorbed gas composition, formation pressure, and cumulative production of methane prior to injection of the inert gas.

In most cases, gaseous methane-containing mixture will be recovered from the solid carbonaceous subterranean formation through one or more production wells in fluid communication with the injection well or wells. Preferably, the production well terminates in one or more methane-containing seams, such as coal seams located within a coalbed. While intraseam termination is preferred, the production well need not terminate in the seam as long as fluid communication exists between the methane-containing portion of the formation and the production well. In many cases, it will be preferable to operate more than one production well in conjunction with one or more injection wells. The production well is operated in accordance with conventional coalbed methane recovery wells. It may, in some cases, be preferable to operate the production well at minimum possible backpressure to facilitate the recovery of the methane-containing fluid from the well.

Spacing between an injection and production well is believed to affect both the quantity and quality of gas withdrawn from a production well during inert gas injection. All other things being constant, a smaller spacing between injection and productions wells typically will result in both an increase in the recovery rate of methane and a shorter time before injected inert gas appears at a production well. When spacing the wells, the desirability of a rapid increase in methane production rate must be balanced against other factors, such as earlier inert gas breakthrough in the recovered gaseous mixture. If the spacing between the wellbores is too small, the injected gas will pass through the formation to the production well without being efficiently utilized to desorb methane from within the carbonaceous matrix.

In most cases, injection and production wells will be spaced 100 to 10,000 feet apart, with 1000 to 5000 feet apart being typical. It is believed that the effects of injected gas on production rate at a distant production well generally decreases with increased spacing between the injection and production well.

Preferably, the methane-containing fluid recovered from the well typically will contain at least 65 percent methane by volume, with a substantial portion of the remaining volume percent being the oxygen-depleted gas stream injected into the formation. Relative fractions of methane, oxygen, nitrogen and other gases contained in the produced mixture will vary with time due to methane depletion and the varying transit times through the formation for different gases. In the early stages of well operation, one should not be surprised if the recovered gas closely resembles the in situ composition of coalbed methane. After continued operation, significant amounts of the injected inert gas can be expected in the recovered gas.

The production rate of a methane-containing gas during inert gas injection is expected to exceed a standard initial production rate of a given well by a factor of 1.1 to 5, or in some cases 10 or more. The term "standard initial production rate" refers to the actual or predicted methane-containing gas production rate of a production well just before flowing a methane-desorbing gas through the well to increase its production rate. A standard initial production rate may be established by allowing a well to operate as a pressure depletion well for a relatively short period of time immediately preceding inert gas injection. The standard initial production rate can then be calculated by averaging the production rate over that period of time. If this method is used, the well preferably will have been operated long enough that the transient variations in production rates do not exceed about 25 percent of the average production rate. Preferably, the standard initial production rate is determined by maintaining constant operating conditions, such as operating at a constant bottom hole flowing pressure with little or no fluid level.

Where actual production rate data is unavailable, a standard initial production rate may be calculated based on various reservoir parameters. Such calculations are well-known in the art, and can yield production estimates based on parameters such as the results of well pressure tests or the results of core analyses. Examples of such calculations can be found in the 1959 Edition of the "Handbook of Natural Gas Engineering" published by the McGraw-Hill Book Company, Inc., of New York, N.Y. While such estimates should be prove to be accurate within a factor of two or so, it is preferred to determine the standard initial production rate by actually measuring produced gas.

Injection of the inert methane-containing gas may be terminated at any time after an enhanced production rate has been established. Typically, injection will be terminated when the amount of inert gas present in the produced methane-containing mixture exceeds a particular composition limit, or because the injection equipment is believed to be more useful at another site.

After termination of inert gas injection, two heretofore unexpected events have been observed. First, although the total production rate declines, the production rate remains enhanced above the standard initial production rate of the well for a significant period of time. Additionally, where inert gas has been found in the methane-containing gas exiting the production well, the volume percent of inert gas in the mixture decreases with time. These effects are illustrated by the following Example.

Example 1

A pilot plant test of this invention was carried out in a coalbed methane field containing two production wells. Each of the production wells was producing a methane-containing gas for about 4 years prior to this test from a twenty-foot thick coal seam located at an approximate depth of 2,700 feet below the surface. One of the production wells was removed from service to be used as an injection well, and three additional injection wells were provided by drilling into the same coal seam at three additional locations. The five wells can be visualized as a "five spot" on a domino covering an 80-acre square area with the injection wells surrounding the production well (i.e. the injection wells were located at the corners of the "five spot" about 1800′ from each other).

Inlet air was compressed to about 140 psig by two air compressors in parallel and passed through a skid mounted 10′×10′×20′ "NIJECT" membrane separation unit equipped with hollow fiber bundles. The compressed air on the outside of the fibers provided the driving energy for oxygen, $CO_2$ and water vapor to permeate the hollow fibers, while a oxygen-depleted, nitrogen-rich stream passed outside of the fiber. About 540,000 cubic feet of oxygen-enriched air containing about 40% by volume oxygen exited the unit each day. Nitrogen-rich gas containing between about 4 to 5 volume percent oxygen exited the membrane separation unit at about the inlet pressure. This nitrogen-rich gas was compressed to approximately 1000 psig in a reciprocating electric injection compressor and injected into the four injection wells at a rate of about 300,000 cubic feet per day per well for several months.

Within one week after injection began, the volume of gas produced from the production well increased from the measured standard initial production rate of 200,000 cubic feet of gas per day to a fully-enhanced production rate of between 1.2 to 1.5 million cubic feet of gas per day. Injection of the nitrogen-rich gas continued for about one year. During the one-year injection period, well production remained relatively constant. Initially the well produced very little nitrogen, but over time the nitrogen content increased steadily to about 35 volume percent. FIG. 1 illustrates a smoothed average of total well production and percent nitrogen found in the produced methane-containing mixture before, during and after injection of the nitrogen-rich gas.

After injection of the inert gas was terminated, the production rate declined sharply at first, but then began to fall off more slowly. Over the forty-day "tail" period after injection was terminated, well production surprisingly never decreased below about 400,000 standard cubic feet per day, about a factor of 2 greater than the standard initial production rate of the well. Furthermore, during this forty-day period, the volume percent of nitrogen found in the produced gas unexpectedly decreased from an initial value of about 35 volume percent to a final value of about 25 volume percent.

The inventive process exploits these surprising findings. Prior to the discovery of these phenomena, one of ordinary skill might conclude that injection and production should be terminated when the inert gas present in the recovered methane-containing mixture increased to an undesired volume percent or that enhanced production would not be possible if, for some reason, the source of inert gas became temporarily or permanently unavailable. To the contrary, our Example 1 shows that enhanced production levels of a gas having a continually decreasing inert gas fraction are available for a substantial period of time following the termination of inert gas injection. Thus, a preferred process is to continue to recover the methane-containing product after injection of the inert gas is terminated, rather than to simply cap the well and move on to another site as might otherwise be done.

It is believed that both the rate of decline in recovery rate and rate of decline in inert gas concentrations during the tail period as just described will vary for any particular injection and production well system. In addition to the basic geological parameters affecting natural gas production generally, factors believed to affect the decline in recovery rate and inert gas concentration include the duration and magnitude of inert gas injected, the type or types of inert gas injected, and amount of formation methane depletion.

Our process provides additional advantages when applied to a system of several wells as illustrated by Example 2, below.

Example 2

Figure 2:
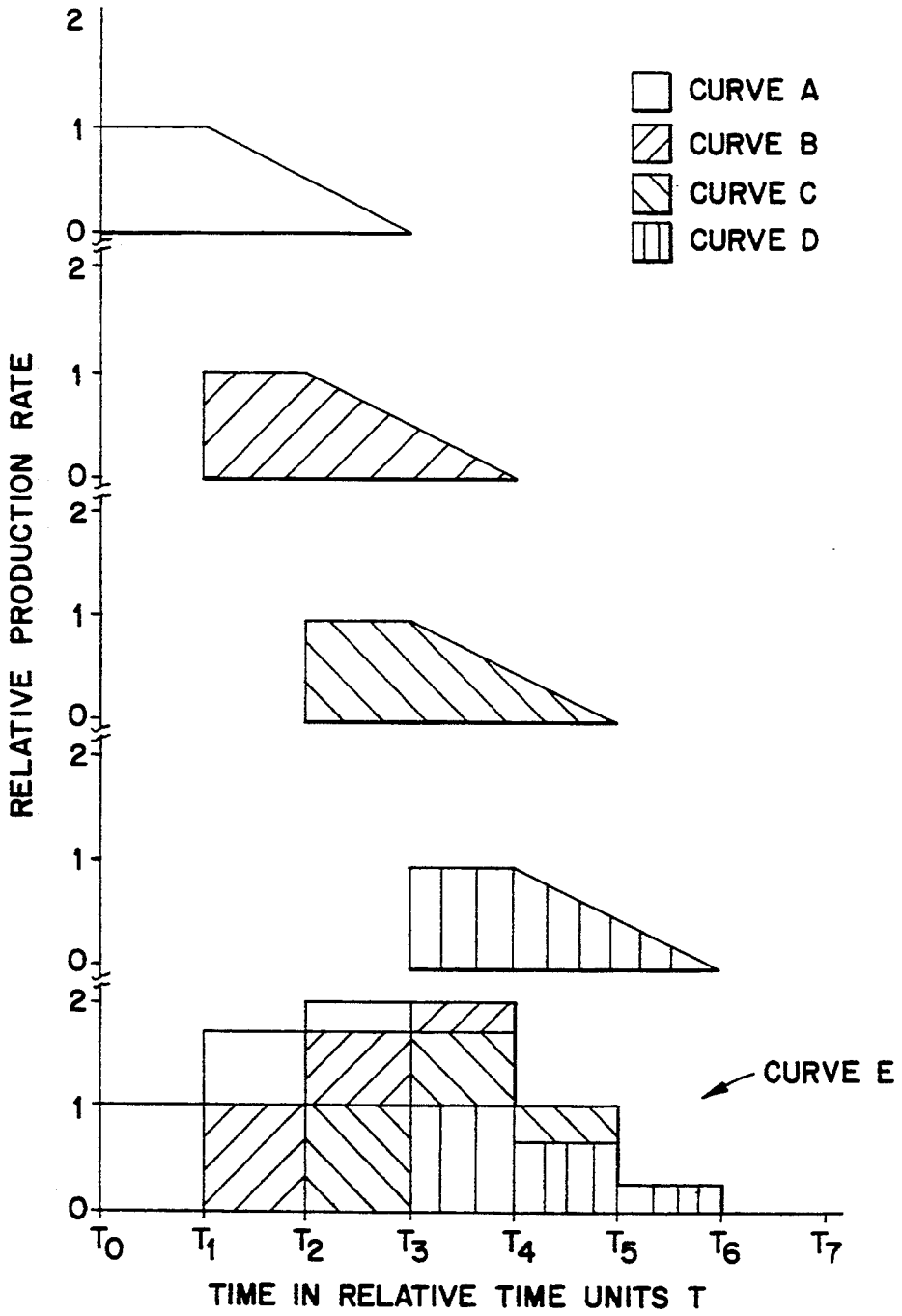
FIG. 2 is a plot illustrating how the production of several wells may be improved by serially operating the wells in accordance with the present invention.

In this Example, a hypothetical module of four injection and production well systems is operated in accordance with the present invention, with the rate and quantity of production from each well and for the total production of the four production wells graphically represented on FIG. 2. Each of the four production wells is located within the same formation or different formations, with each production well assumed to be associated with a formation location into which an inert gas can be injected to enhance methane-containing gas production from the associated production well.

Curve A illustrates the total gas production of a first well operated during a period of inert gas injection from time T0 to time T1, followed thereafter by a tail period of declining enhanced recovery in the absence of inert gas injection from time T1 until time T3. Curve B illustrates the total gas production of a second well operated during a period of inert gas injection from time T1 to time T2, followed thereafter by a tail period of declining enhanced recovery in the absence of inert gas injection from time T2 until time T4. Curve C illustrates the total gas production of a third well operated during a period of inert gas injection from time T2 to time T3, followed thereafter by a period of enhanced recovery in the absence of inert gas injection from time T3 until time T5. Curve D illustrates the total gas production of a fourth well operated during a period of inert gas injection from time T3 to time T4, followed thereafter by a tail period of declining enhanced recovery in the absence of inert gas injection from time T4 until time T6.

For ease of explanation, the production rate obtained from each well during inert gas injection is assumed to be constant and equal. For each Curve A through E on FIG. 2, the vertical axis represents relative production rate while the horizontal axis represents time units. The area under each curve is therefore proportional to the total quantity of methane-containing gas produced from each respective well. As can be seen by comparing Curves A through D, an inert gas is continuously injected into a formation or formations from time T0 to time T4, but gas is only injected into a single well at any given time.

Curve E is a histographic representation of the summed methane-containing gas produced by the four wells averaged over intervals equal to one time unit. The various shadings on Curve E are the same as those used on Curves A through D and indicate the portion of the total production contributed by Curves A through D. As can be seen by comparing Curve E to Curves A through D, total gas production obtained by injecting inert gas serially into the four injection and production well systems exceeds that obtainable by continuous injection into a single injection and production well system by a substantial amount.

The serial injection method just described is particularly advantageous because it permits a single inert gas production and injection apparatus to be used to provide for natural gas production in excess of that obtained if the single inert gas production and injection unit remained in service at a single well system for an identical period of time. Although total production from the inventive method is likely to be somewhat less than is obtained by simultaneously injecting into a plurality of well systems, operating costs incurred from the serial injection method are substantially diminished by the use of only a single inert gas production and injection apparatus. Furthermore, because the relative volume percent of inert gas is believed to decrease with time throughout the tail period of a well, the output of wells undergoing injection and in tail periods can be combined to yield a gaseous mixture having a relatively lower inert gas volume percent, thereby facilitating downstream use and/or reducing processing costs of the mixture, further lessening or delaying capital costs.

Other variations of the serial injection method just described can provide production advantages. The benefits of post-injection enhanced recovery can be obtained in any situation in which the number of operating well systems exceeds the number of available inert gas production and injection units and in which the injection of an inert methane-desorbing gas provides for enhanced post-injection recovery in one or more wells. In these cases, maximum production will be obtained by continuously injecting into as many injection and production well systems as possible while simultaneously recovering methane-containing gases from other well systems that are producing gas in the post-injection or tail portion of the recovery process. Where multiple gas production and injection units are available and several wells are simultaneously operated in the post-injection enhanced recovery phase, production and injection units should be placed in service on the post-injection units exhibiting the lowest post-injection recovery when inert gas units from other well systems entering the tail portion of the recovery process become available.

The foregoing descriptions provide several examples of the subject invention wherein methane production from a solid carbonaceous subterranean formation is enhanced in the absence of inert gas injection.

It should be appreciated that various other embodiments of the invention will be apparent to those skilled in the art through modification or substitution without departing from the spirit and scope of the invention as defined in the following claims.

We claim:

1. A method for increasing the production of methane from a solid carbonaceous subterranean formation having a standard initial production rate of a methane-containing gas of X standard cubic feet per unit time, where X is a positive number, said method comprising the steps of:

injecting an inert methane-desorbing gas into the formation;

recovering greater than X standard cubic feet per unit time of a first methane-containing gas from the formation during the injecting step;

terminating injection of the methane-desorbing gas; and thereafter recovering greater than X standard cubic feet per unit time of a second methane-containing gas from the formation.

2. The method of claim 1 wherein the methane-desorbing gas is injected into the formation through a first well and wherein the first and second methane-containing gases are recovered from the formation through a second well.

3. The method of claim 2 wherein the second methane-containing gas recovered from the second well is recovered at a rate exceeding the product of 1.1 multiplied by X standard cubic feet per unit time.

4. The method of claim 2 further comprising the step of recovering the first methane-containing gas from the second well during at least a portion of the injecting step at a rate exceeding the product of 2 multiplied by X standard cubic feet per unit time.

5. The method of claim 2 wherein the inert methane-desorbing gas is air.

6. The method of claim 2 wherein the inert methane-desorbing gas comprises greater than 80 volume percent nitrogen.

7. The method of claim 2 in which a first portion of the second methane-containing gas produced in a first portion of the recovering step has a methane-desorbing gas volume percent of Y percent, where Y is a positive number, and in which a second portion of second methane-containing gas produced thereafter during a second portion of the recovering step has a methane-desorbing gas volume percent less than Y percent.

8. The method of claim 6 in which a first portion of the second methane-containing gas produced in a first portion of the recovering step has a methane-desorbing gas volume percent of Y percent, and in which a second portion of the second methane-containing gas produced thereafter during a second portion of the recovering step has a methane-desorbing gas volume percent less than Y percent.

9. The method of claim 1 wherein the recovering step is not performed until at least 30 days after the terminating step.

10. The method of claim 8 wherein at least a portion of the recovering second step is performed in the absence of inert gas injection.

11. The method of claim 8 wherein the inert methane-desorbing gas comprises greater than 90 volume percent nitrogen.

12. A method for increasing the production of methane from a coalbed having a standard initial production rate of a methane-containing gas of X standard cubic feet per unit time, where X is a positive number, said method comprising the steps of:

injecting an inert methane-desorbing gas into the coalbed at a formation location while recovering a methane-containing gas therefrom during at least a portion of the injecting step;

terminating injection of the methane-desorbing gas; and thereafter recovering a first methane-containing gas from the coalbed at a rate greater than the product of 1.5 multiplied by X standard cubic feet per unit time in the absence of inert methane-desorbing gas injection into the formation location.

13. The method of claim 12 wherein the methaneodesorbing gas is injected into the formation through a first well and wherein the methane-containing gas is withdrawn from the formation through a second well.

14. The method of claim 13 further comprising the step of recovering a second methane-containing gas from the second well during at least a portion of the injecting step at a rate exceeding the product of 2 multiplied by X standard cubic feet per unit time.

15. The method of claim 12 wherein the inert methane-desorbing gas comprises at least 90 volume percent nitrogen.

16. The method of claim 13 wherein the inert methane-desorbing gas is air.

17. The method of claim 14 wherein the first and second wells are located between 1000 and 5000 feet apart.

18. The method of claim 13 in which a first portion of the first methane-containing gas produced in a first portion of the recovering step has a methane-desorbing gas volume percent of Y percent, where Y is a positive number, and in which a second portion of the first methane-containing gas produced thereafter during a second portion of the recovering step has a methane-desorbing gas volume percent of less than Y percent.

19. The method of claim 14 in which a first portion of the first methane-containing gas produced in a first portion of the recovering step has a methane-desorbing gas volume percent of Y percent, and in which a second portion of the first methane-containing gas produced thereafter during a second portion of the recovering step has a methane-desorbing gas volume percent of less than Y percent.

20. The method of claim 15 wherein methane-desorbing gas is injected into the coalbed through a first well and the methane-containing gas is withdrawn from the coalbed through a second well and wherein the first and second wells are located between 1000 and 5000 feet apart.

21. The method of claim 13 wherein the recovering step is not performed for at least 30 days following the terminating step.

22. A method for increasing the production of methane from a first and second well penetrating at least one solid carbonaceous subterranean formation, said first and second wells having standard initial production rates of methane-containing gas of X and Y standard cubic feet per unit time, respectively, where X and Y are positive numbers, said method comprising the steps of:

injecting a first inert methane-desorbing gas into a first formation location to recover a first methane-containing gas at a rate greater than X standard cubic feet per unit time from the first well;

terminating injection of the first methane-desorbing gas into the first formation location; and thereafter injecting a second methane-desorbing gas into a second formation location to recover a second methane-containing gas at a rate greater than Y standard cubic feet per unit time from the second well, while recovering a third methane-containing gas at a rate greater than X standard cubic feet per unit time from the first well.

23. The method of claim 22 further comprising the steps of:

terminating injection of methane-desorbing gas into the second formation location; and thereafter recovering greater than Y standard cubic feet per unit time of a fourth methane-containing gas from the second well.

24. The method of claim 23 wherein the third and fourth methane-containing gases are simultaneously recovered from the first and second wells at rates greater than the product of 2 multiplied by X and the product of 2 multiplied by Y standard cubic feet per unit time, respectively.

25. The method of claim 23 further comprising the steps of:

injecting a third inert methane-desorbing gas into a third formation location in fluid communication with a third well, said third well having a standard initial production rate of Z standard cubic feet per unit time of methane-containing gas, where Z is a positive number, to recover a fifth methane-containing gas at a rate greater than Z standard cubic feet per unit time from the third well;

thereafter terminating injection into the third formation location; and thereafter recovering a sixth methane-containing gas from the third well at a rate greater than Z standard cubic feet per unit time.

26. The method of claim 22 further comprising the step of recovering the first methane-containing gas from the first well at a rate exceeding the product of 4 multiplied by X standard cubic feet per unit time while injecting the first methane-desorbing gas into the first formation location.

27. The method of claim 23 further comprising the step of recovering the second methane-containing gas from the second well at a rate exceeding the product of 4 multiplied by Y standard cubic feet per unit time while injecting the second methane-desorbing gas into the second formation location.

28. The method of claim 22 wherein the first or second methane-desorbing gas comprises at least 90 volume percent nitrogen.

29. The method of claim 22 wherein the first or second inert methane-desorbing gas is selected from the group consisting of atmospheric air, oxygen-depleted atmospheric air, and mixtures thereof.

30. The method of claim 22 further comprising the step of utilizing a single source of methane-desorbing gas to inject the first methane-desorbing gas into the first formation location and thereafter to inject the second methane-desorbing gas into the second formation location.

31. The method of claim 30 further comprising the step of using the single source of gas to inject a third methane-desorbing gas into a third formation location after using the single source of gas to inject the second methane-desorbing gas in the second formation location.

32. A method for increasing the production of methane from a coalbed having a standard initial production rate of a methane-containing gas of X standard cubic feet per unit time, where X is a positive number, said method comprising the steps of:

injecting an inert methane-desorbing gas into the coalbed at a formation location;

terminating injection of the methane-desorbing gas; and thereafter recovering a first methane-containing gas from the coalbed at a rate greater than the product of 1.5 multiplied by X standard cubic feet per unit time in the absence of inert methane-desorbing gas injection into the formation;

wherein said injection into the formation is through a first well and wherein the methane-containing gas is withdrawn from the formation through a second well.

33. The method of claim 32 further comprising the step of recovering a second methane-containing gas from the second well during at least a portion of the injecting step at a rate exceeding the product of 2 multiplied by X standard cubic feet per unit time.

34. The method of claim 32 wherein the inert methane-desorbing gas comprises at least 90 volume percent nitrogen.

35. The method of claim 32 wherein the inert methane-desorbing gas is air.

36. The method of claim 32 wherein the first and second wells are located between 1000 and 5000 feet apart.

37. The method of claim 32 in which a first portion of the first methane-containing gas produced in a first portion of the recovering step has a methane-desorbing gas volume percent of Y percent, where Y is a positive number, and in which a second portion of the first methane-containing gas produced thereafter during a second portion of the recovering step has a methane-desorbing gas volume percent of less than Y percent.

38. The method of claim 33 in which a first portion of the first methane-containing gas produced in a first portion of the recovering step has a methane-desorbing gas volume percent of Y percent, and in which a second portion of the first methane-containing gas produced thereafter during a second portion of the recovering step has a methane-desorbing gas volume percent of less than Y percent.

39. The method of claim 34 wherein the first and second wells are located between 1000 and 5000 feet apart.

40. The method of claim 32 wherein the recovering step is not performed for at least 30 days following the terminating step.

* * * * *

UNITED STATES PATENT AND TRADEMARK OFFICE

CERTIFICATE OF CORRECTION

PATENT NO. : 5,388,640

DATED : February 14, 1995

INVENTOR(S) : Rajen Puri, Dan Yee

It is certified that error appears in the above-indentified patent and that said Letters Patent is hereby corrected as shown below:

| Col. | Line | |
|---|---|---|
| 14 | 29-30 | "the methaneodesorbing gas" should read --the methane-desorbing gas-- |

Signed and Sealed this

Tenth Day of October, 1995

Bruce Lehman

*Attest:*

BRUCE LEHMAN

*Attesting Officer*

*Commissioner of Patents and Trademarks*